US005222679A

United States Patent [19]

Dropczynski et al.

[11] Patent Number: 5,222,679

[45] Date of Patent: Jun. 29, 1993

[54] METHOD OF AND APPARATUS FOR AUTOMATIC REPLACEMENT OF A FULLY WOUND ROLL BY A NEW SLEEVE IN A WINDING MACHINE

[75] Inventors: Hartmut Dropczynski, Dormagen; Ernst G. Urban, Neuss, both of Fed. Rep. of Germany

[73] Assignee: Jagenberg Aktiengesellschaft, Dusseldorf, Fed. Rep. of Germany

[21] Appl. No.: 653,352

[22] Filed: Feb. 6, 1991

[30] Foreign Application Priority Data

Feb. 7, 1990 [DE] Fed. Rep. of Germany ..... 4003504

[51] Int. Cl.[5] ..... B65H 35/02; B65H 19/20

[52] U.S. Cl. ..... 242/56.8; 242/56 R

[58] Field of Search ..... 242/56 R, 66, 56.8, 242/67.1 R

[56] References Cited

U.S. PATENT DOCUMENTS

| | | | |
|---|---|---|---|
| 4,370,193 | 1/1983 | Knauthe | 242/56 R X |
| 4,408,727 | 10/1983 | Dropczynski | 242/56 R |
| 4,422,588 | 12/1983 | Nowisch | 242/56 R X |
| 4,444,360 | 4/1984 | Kaipf et al. | 242/56 R |
| 4,485,979 | 12/1984 | Dropczynski | 242/56 R |
| 4,635,867 | 1/1987 | Kytonen | 242/56 R |
| 4,775,110 | 10/1988 | Welp et al. | 242/56.8 |
| 4,789,109 | 12/1988 | Kyytsonen et al. | 242/56 R |

FOREIGN PATENT DOCUMENTS

| | | |
|---|---|---|
| 8107184.1 | 8/1982 | Fed. Rep. of Germany . |
| 3109587C1 | 11/1982 | Fed. Rep. of Germany . |
| 3207461 | 9/1983 | Fed. Rep. of Germany . |

*Primary Examiner*—Katherine Matecki
*Assistant Examiner*—John F. Rollins
*Attorney, Agent, or Firm*—Herbert Dubno; Yuri Kateshov

[57] ABSTRACT

A cradle-type winding machine has a pair of driven rollers receiving the sleeves on which the web is to be wound in a winding bed and a weakening device perforating the web upon temporary halting of the latter. A support can be raised into the winding bed and carries both a clamping roller and a swingable blade, the former being effective to clamp the web against one of the support rollers for the winding of heavy paper stack while the latter can be swung into a position enabling the tearing of light paper stack. When heavy paper stack is used, a perforator along the path of the web before it encounters the support rollers against which it is to lie is provided to perforate the web across its width and form a weakened zone on opposite sides of which adhesive strips are provided.

7 Claims, 2 Drawing Sheets

METHOD OF AND APPARATUS FOR AUTOMATIC REPLACEMENT OF A FULLY WOUND ROLL BY A NEW SLEEVE IN A WINDING MACHINE

FIELD OF THE INVENTION

Our present invention relates to a method for automatically replacing a fully wound roll of a web of flexible material with a new sleeve onto which a fresh roll of the web can be formed in cradle-type roll-winding machines. The invention also relates to a cradle-type roll-winding machine for this purpose. A cradle-type roll-winding machine is a roll-winding machine in which two support rollers form a winding bed between them and on which one or more roll-winding sleeves can rest so that, as the rollers are driven, they frictionally entrain the sleeve and then the roll formed on the sleeve to wind the web onto the sleeve and build a roll cradle between the two support rollers.

BACKGROUND OF THE INVENTION

In roll-winding machines for the winding of paper, paperboard or cardboard webs onto respective sleeves, cradle-type roll-winding machines may be used. In the past, for a roll replacement, i.e. the removal of a fully-wound roll and its replacement by a new sleeve onto which a roll is to be built, the machine has generally been brought to standstill.

It is desirable in this industry to reduce the standstill time of the machine to a minimum and nevertheless ensure, after severing of the web to form a trailing end and a new leading end, that the new leading end can be applied effectively to the new sleeve so that the new winding cycle can commence with a minimum of difficulty.

In the automated roll-replacement system described in German patent document DE-OS 29 20 707, the roll-replacement method retains the web which is fed between the support rollers during the separation by suction on the periphery of one of these support rollers. The separation of the web is effected by means of a separating device raised through the gap between the support rollers and provided with a tearing blade which tears the web upon the ejection of the fully-wound roll from the machine. This method can only be used effectively with light papers (up to about 120 g/m$^2$). With heavier types of paper, the separation of the web against an inactive tearing blade of this type and the retention of the web against the support roller create problems which have not been solved in this earlier system.

Cradle-type roll winding machines for heavier paper can utilize the principles of the German patent document DE-OS 31 51 256 in which swingable levers can pivot about the axis of one of the support rollers and carry a device for cutting the web and effecting adhesion thereof. The cutting device is an active blade movable across the width of the web and which severs the web upon the winding sleeve. The newly formed leading edge of the web can then be adhered to the sleeve substantially concurrently with the cutting operation.

The device for severing the web and causing adhesion of the leading edge to the sleeve is structurally complex and hence relatively expensive and its operation takes comparatively a long time.

In German patent document DE-OS 36 11 895, a roll-replacement process is described for a support roll-winding machine in which the web, before it reaches the support roll, is weakened and receives a trace of adhesive on both sides of the weakened zone. The separation of the web along the weakened zone is effected by braking the web while the latter lies against the support roll. The leading and trailing web ends formed by the separation adhere to the support roller by suction developed therein until they reach the roll to be wound and the trailing end is then bonded to this roll. The new leading end remains braked during this movement so that the support roll must rotate beneath the leading band and which is held by suction thereagainst until the fully-wound roll is discharged and the braking action is released to permit further advance of the leading end and its adhesion by a respective adhesive trace to the new sleeve.

OBJECTS OF THE INVENTION

It is the principal object of the present invention to provide an improved method of replacing the fully-wound roll by a new sleeve upon which rolling can be effective whereby drawbacks of earlier systems are avoided.

Another object of this invention is to provide a method for the purposes described which can be used in cradle-type roll-winding machines for heavy paper types (greater than 120 g/m$^2$) as well as for light paper types and which nevertheless will permit high speed and reliable roll replacement.

Still another object of the invention is to provide a method which can be carried out by retrofitting upon existing machines, thereby increasing the versatility thereof.

It is also an object of our present invention to provide an improved roll-winding machine with effective roll-replacement capability.

SUMMARY OF THE INVENTION

These objects are attained, in accordance with the present invention, in a method of automatically exchanging a new roll-winding sleeve for a fully-wound roll in a roll-winding machine wherein a roll is wound on the sleeve while it is cradled on two support rollers in a winding bed, the two support rollers having a support roller gap between them. The method advantageously comprises the steps of:

(a) feeding a web of flexible material to be rolled from below through the gap onto a first of the rollers to wind the web on a core and build a roll cradled on a rolling bed formed by the rollers above the gap;

(b) temporarily halting advance of the web;

(c) while advance of the web is temporarily halted, weakening the web along a separation line at a location upstream of contact of the web with the first roller and applying adhesive to the web on opposite sides of the separation line;

(d) thereafter displacing the web to advance the separation line to a location on the first roller below a contact line of a new roll-winding sleeve with the first roller;

(e) holding a portion of the web upstream of the separation line and adapted to form a new leading end for a roll to be wound against the first roller;

(f) then rotating the fully wound roll by driving the second of the rollers while braking advance of the web to separate the web along the separation line and apply the adhesive on a trailing end of the web downstream of the separation line to the fully wound roll, thereby retaining the trailing end thereagainst;

(g) thereafter removing the fully wound roll from the winding bed;

(h) depositing a new roll-winding sleeve in the bed on the rollers; and (i) driving both of the rollers to advance the leading end of the web and adhesive thereon into contact with the new roll-winding sleeve and effect winding of the web thereon to form a fully wound roll.

According to a feature of the invention, prior to separation of the web in step (f), the fully wound roll is lifted from the first roller by an ejection roller bearing on the fully wound roll, the trailing end then is passed between the fully wound roll and the ejection roller, and the ejection roller thereafter pushes the fully wound roll over the second roller from the winding bed.

This method, quite surprisingly, can achieve the objects described above but has, in addition, the important advantage that it can be retrofitted to support roller-winding machines, i.e. cradle-type roll-winding machines which have previously been used or are useful only for light types of paper, like those of German patent document DE-OS 29 20 707 and DE-OS 29 48 877 to enable these machines to operate additionally with heavy types of paper.

The so-equipped or retrofitted cradle-type winding machines can thus handle paper or cardboard webs over the full range of weights per unit area and specifically permit roll winding and roll replacement operations approximately with speeds which have been unattainable with light paper types heretofore.

According to another aspect of the invention, a roll-winding machine can comprise two driven support rollers defining a gap between them and forming a roll-winding bed upon which a sleeve to receive the web and a roll wound on this sleeve can be formed. The web of flexible material is fed from below along the surface of a first of these support rollers and is guided therealong between the two support rollers through the aforementioned gap.

The ejector means can include an ejector roller engageable with a fully-wound roll in the winding bed to lift the fully-wound roll from the first support roller over the second support roller out of the bed. Weakening means is provided at a location upstream of contact of the web with the first support roller and can include a perforating device forming a line of perforations across the width of the web and means for applying adhesive on opposite sides of this separating line.

The means for applying adhesive may be an adhesive tape dispenser which applies a so-called double backed tape to the web, preferably continuously across the width of the tape. Means is also provided to clamp the web against the first support roller in a region thereof along which the web extends in contact with the first support roller and, in addition, we provide a device for inserting a new sleeve in the winding bed.

According to a feature of the invention, the clamping roller is spring-loaded and freely rotatable on a prop or support to serve as a clamping device which can be lifted through the gap between the support rollers into the region of the winding bed. The first support roller can be formed as a suction roller or drum and at the end of the above-mentioned support, above the clamping roller, a separating blade maybe pivotally mounted to swing in the direction of the first support roller to provide a tearing edge for the web.

This has been found to be especially advantageous for handling paper, paperboard or cardboard over the full range of weights per unit area with extremely small standstill time for the roll replacement.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
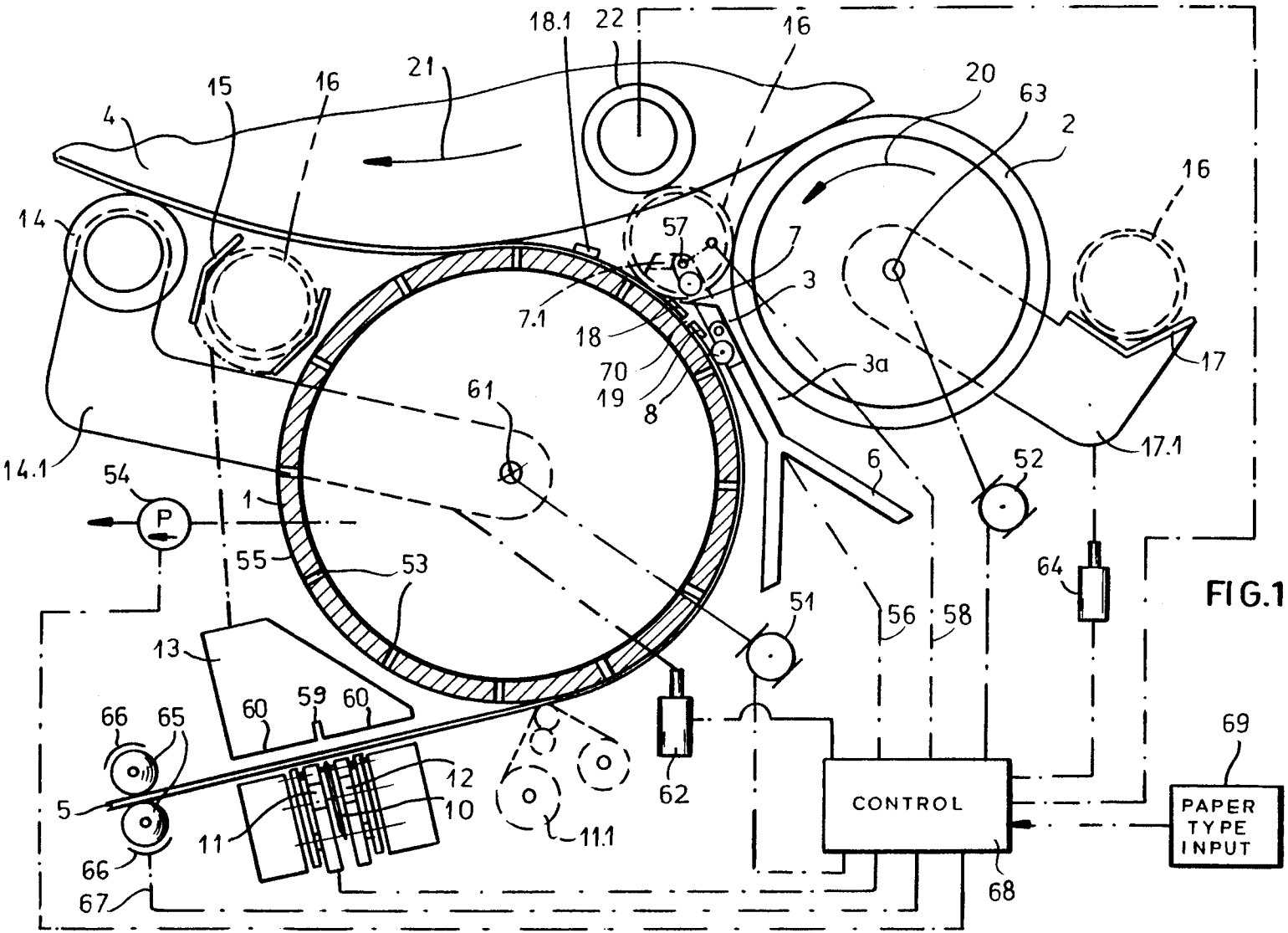
FIG. 1 is a highly schematic side elevational view, partly in section of the key elements of a cradle-type roll-winding machine capable of roll replacement, the solid lines representing the parts effective for roll replacement with heavy paper types while broken lines represent the parts which are effective for light paper roll winding.

The cradle-type winding machine of the invention comprises two driven support rollers 1 and 2 which have been diagrammatically illustrated as having respective drive motors 51 and 52, defining a winding bed 3 into which an upwardly extending gap 3*a* between these rollers opens. A roll 4 of the wound web 5 is cradled in the bed 3 which also can receive a new roll-winding sleeve 16 to commence the winding of a new roll 4.

The web 5, preferably of paper, paperboard or cardboard, may be longitudinally subdivided into a plurality of strips, each of which is wound upon respective sleeves 16, so that it will be understood in FIG. 1, a plurality of sleeves 16 may be arrayed one behind the other in a direction perpendicular to the plane of the paper.

The web 5 is fed from below around the support roller 1 which may be a suction roller, i.e. provided with perforations 53 and to which suction may be applied by a suction pump 54.

The support roller 1 carries the web 5 through the gap 3*a* between the support rollers 1 and 2 to the sleeve 16 which may be flush with one another.

The principles of such double-roller winding machines or cradle-type winding machines are well known and reference may be had, in this regard to German patent document DE-OS 32 07 461 so that details of the machine, to the extent that they are not necessary for an understanding of the present invention, have not been described, although reference may be had to this patent document and to earlier cradle-type winding machines for such details.

The support roller 1, because of the suction applied thereto, can retain the web 5 against the periphery 55 of this support roller.

In the gap 3*a* between the two support rollers 1 and 2, a machine-width support or prop 6 raisable and lowerable between the support rollers 1 and 2, can be provided. The means for raising and lowering the support 6 is represented at 56.

At its upper end, the support 6 is formed with a separating blade 7 which is swingable about a pivot 57 by means represented diagrammatically at 58, i.e. from the solid-line position shown to the broken line position illustrated, toward the periphery 55 of the support roller 1.

This blade 7, which also extends the full machine width, i.e. the width of the web, can be moved into the winding bed 3 through the gap 3*a* by the lifting of the support 6 so that it can engage in the upper wedge-shaped region between the two support rollers 1 and 2 but can also be withdrawn into a position in which it does not interfere with the winding operation.

Below the pivot 57, the support 6 carries a plurality of freely rotating and resiliently mounted rollers 8, only one of which has been shown in FIG. 1, but which are arrayed one behind the other perpendicular to the plane of the paper, and are so positioned that in approximately the narrowest portion of the gap 3*a*, these rollers can press the web 5 against the periphery 55 of the first support roller 1.

At the inlet side of the apparatus, shortly before the web 5 contacts the first support roller 1, a perforating device 10 is provided, this perforating device being flanked by two adhesive tape dispensers 11 and 12.

The perforating device 10 comprises a toothed wheel or blade displaceable across the full machine width and cooperating with a groove 59 in a countermember 13. The countermember 13 provides abutment surfaces 60 flanking the groove 59 and against which the web 50 is supported during application of the double-sided adhesive tape.

While two adhesive tape dispensers 11 and 12 are provided here to ensure that adhesive tape strips 18 and 19 will be dispensed on opposite sides of the perforating or separating line formed across the width of the web, it is also possible to apply a single broad double-sided adhesive tape first and then form the perforations so that the tape will be perforated as well into two strips on either side of the weakened zone formed by the perforation line.

In another alternative, represented in broken line in FIG. 1 transverse to the machine width, a plurality of adhesive tape dispensers 11.1 are provided that apply adhesive strips in the web travel direction. This has the advantage that the adhesive strips will be applied by means of the movable web. The standstill time of the winding machine can thereby be further reduced since the adhesive tape application can occur after restarting of the machine following formation of the perforations.

To eject the fully-wound roll 4, an ejectro roller 14 is mounted on swingable arms 14.1, only one of which is visible in FIG. 1, two of which are provided at opposite ends of the support roller 1 and the ejector roller 14 and which are swingable about the axis 61 of the support roller 1. The means for displacing the arms 14.1 have been represented at 62 in FIG. 1. The support roller 14 is freely rotatable on the arms 14.1.

It has been found to be advantageous from a structural point of view to mount the countermember 13 on the underside of the arms 14.1 (as represented by the double-dot dash line) than when the ejector roller 14 is swung downwardly, the countermember 13 can form an abutment surface for the web 5.

In a conventional manner, the swing arms 14.1 may also carry a sleeve insertion device 15, here represented as a pair of jaws or a sleeve trough which can hold a set of new sleeves which can be swung into the bed and released from the trough or the jaws.

Alternatively, the sleeve insertion device can make use of a trough 17 received on swing arms 17.1 located at opposite ends of the support roller 2 and pivotable about the axis 63 thereof. The means for swinging the arms 17.1 have been represented at 64 in FIG. 1. The winding machine can also have both sleeve insertion devices 15 and 17 with the device 15 being used to insert sleeves of small diameter and the device 17 for the introduction of sleeves of larger diameter.

Upstream of the perforator 10, the rollers 65 feeding the web 5 may be provided with brakes 66 actuated by means represented at 67. The brakes 66, the perforator 10 and the adhesive applicators 11 and 12, the devices 62 and 64 for swinging the arms 14.1 and 17.1, the drives 51 and 52 and the actuators 56 and 58 may all be controlled, e.g. by a computer 68, to which an input may be supplied at 69 representing the type of weight or the weight of the paper to establish the actuating program for the machine in accordance with the description of the roll-change operations as set forth below. This description is effectively an algorithm for the automated control of the devices described.

In the case of the winding of heavy paper types, roll replacement is effected as follows:

When the wound roll has a predetermined web length or a predetermined diameter, the roll-winding machine is automatically stopped, i.e. the drives for the support rollers 1 and 2 are braked. The web 5, in turn, is maintained under tension by the simultaneous application of brakes to the rollers 65 of the roller system delivering the web to the winding machine.

In the region immediately upstream of the support roller 1 around which the web 5 passes, double-sided adhesive strips are applied by the dispensers 11 and 12 over the width of the web. Simultaneously or directly thereafter, the web 5 is perforated over its entire width by a line of perforations representing the separating line and weakening the web. The degree of weakening is set in accordance with the type of material so that the force which is utilized to separate the web will be independent of the type of material of the web and will always be approximately of the same magnitude.

Immediately following perforation, the machine is again started to carry the weakened zone with the two adhesive strips 18 and 19 flanking it to the winding bed 3 but to a location just below the contact line of a new winding sleeve 16 with the support roller 1 when that winding sleeve is subsequently introduced. The web 5 is again stopped and the brakes 66 engaged so that the web 5 is held with maximum force. Simultaneously the support 6 is raised so that the rollers 6 engage the web 5 at a small distance below the weakened zone and clamp the web against the support roller 1. In this operation, the separating blade 7 is not used and thus is not swung toward the support roller 1.

If required, the retention of the web 5 against the support roller 1 can be reinforced by the application of suction to the support roller 1.

Figure 3:
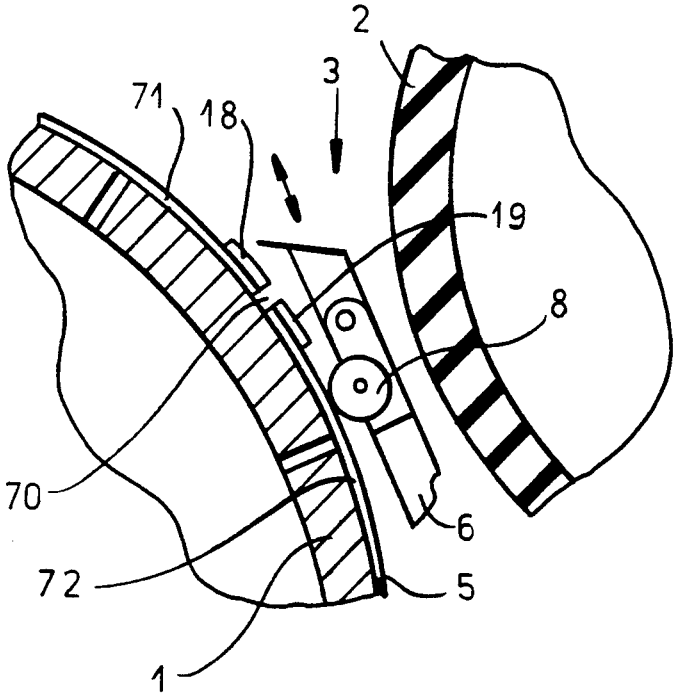
FIG. 3 is a detail view illustrating the effect of the clamping roller in the gap between the support rollers.

The arms 14.1 are then swung in the clockwise sense so that the ejector roller 14 will lift the fully wound roll 4 from the support roller 1, and support roller 2 is driven in the direction of arrow 20, i.e. counterclockwise. This frictionally rotates the roll 4 in the clockwise sense (arrow 21) so that tension is applied to the weakened or perforated zone and separates the web in this region. The separation is shown at 70 in FIG. 1. In FIG. 3 we have shown the engagement of the clamping rollers 8 against the web 5, drawn to a larger scale.

The wound roll 4 is rotated in this manner until the adhesive strip 18 on the trailing end 71 of the web passes through the gap between the ejector roll 14 and the wound roll 4 to fasten this trailing end to the wound roll 4.

The arms 14.1 are then further swung in the clockwise sense so that the ejector roller 14 will push the fully wound roll 4 out of the winding bed 3 over the support roller 2.

Either simultaneously, by means of the sleeve inserter 15, or subsequently by means of the sleeve inserter 17, a set of new sleeves 16 is introduced into the winding bed 3. The pressing roller 22 is then lowered onto the sleeve. The support rollers 1 and 2 are again driven to carry the leading end 71 of the web bearing the adhesive strip 19 into contact with the sleeves 16. As soon as the leading end of the web with the adhesive strip 19 passes the gap between the sleeves 16 and the support roller 1, this leading end will adhere to the sleeves 16 and rolling to the new roll will commence.

The support 6 with the roller 8 is lowered to a position in which the rollers 8 will not engage the web or interfere with the roll-winding operation and the machine can be accelerated to the full roll-winding speed.

It is also possible, prior to the ejection of the fullywound roll 4 and without lifting the fully-wound roll, to separate the web by driving both support rollers 1 and 2. The adhesive strip at the trailing end 71 will then bond to the roll 4 as it passes between the support roller 1 and the roll 4. This method, however, has the disadvantage that the support roller 1 must slide beneath the clamped web 5 which is held by the rollers 4 and that there is time lost by the need to additionally start up the machine.

For the winding of light paper types, a corresponding roll replacement can be effected but with the following differences, since with light papers a weakening of the web is not required, the perforating device 10 will remain inactive. If the trailing web end is to be adhesively bonded to the fully-wound roll 4, the adhesive tape dispenser 11 or 12 can apply an adhesive strip 18.1 to the web. This is advantageously effected during the slowdown of the machine as it is being stopped for the separating operation.

The braking process is so controlled that, upon stopping, the adhesive strip 18.1 will be located in the winding bed 3 above the working position 7.1 of the separating blade 7.

For separation of the web, the support 6 is raised through the gap 3*a* to carry the blade into the winding bed 3 so that a comparatively long leading edge will be formed and thereby more readily wound on the new sleeve 16 without problems.

Figure 2:
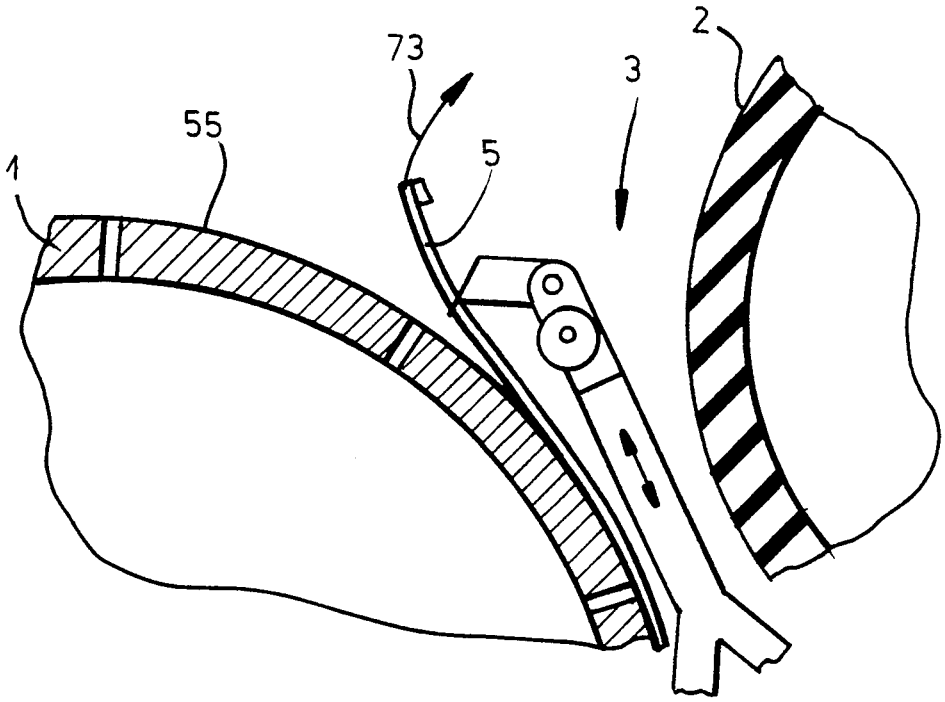
FIG. 2 is a detail view showing the effect of the pivotal blade for the separation of a light paper web.

The support 6, in particular, is raised so that the rollers 8 pass the narrowest region of the gap and thus do not contact the web 5 (see FIG. 2). The web 5 is exclusively held by suction against the surface 55 of the support roller 1. The blade 7 is swung in the direction of support roller 1 and to avoid damage thereto, is held a slight distance therefrom. The tearing of the web is effected by swinging the arms 14.1 in the clockwise direction to lift the web 5 as represented by the arrow 73 in FIG. 2 away from the surface of the support roller 1 and thereby tear the web against the blade 7 which acts as a passive tearing edge.

After ejection of the fully-wound roll 4, the support 6 with its blade 7 swung back to its original position is lowered and a set of new sleeves 16 are inserted. The sleeve 16 can have, in the conventional manner, adhesive strips or traces of glue provided thereto to engage the leading end of the web. The winding of the leading end of the web on the sleeve 16 is effected automatically upon application of the pressing roller 22 to the sleeve 16 upon restarting of the winding machine by rotation of the two supporting rollers 1 and 2.

We claim:

1. A method of automatically exchanging a new roll-winding sleeve for a fully wound roll in a roll-winding machine wherein a roll is wound on said sleeve while cradled on two support rollers having a horizontal support-roller gap between them, said method comprising the steps of:

(a) feeding a web of flexible material to be rolled from below through said horizontal gap onto a first of said rollers to wind said web on a core and build a roll cradled on a rolling bed formed by said rollers above said gap;

(b) temporarily halting advance of said web;

(c) while advance of said web is temporarily halted, weakening said web along a separation line at a location upstream of contact of said web with said first roller and applying adhesive to said web on opposite sides of said separation line;

(d) thereafter introducing a first roll-winding sleeve forming a horizontal support line with said first support roller;

(d') simultaneously with step (d) displacing said web to advance said separation line to a location on said first roller immediately upstream of said horizontal contact line;

(e) holding a portion of said web upstream of said separation line and adapted to form a new leading end for a roll to be wound against said first roller at least in part by pressing a freely rotating roller thereagainst;

(f) then rotating said fully wound roll by driving the second of said rollers while braking advance of said web to separate said web along said separation line and apply the adhesive on a trailing end of said web downstream of said separation line to said fully wound roll, thereby retaining said trailing end thereagainst;

(g) thereafter removing said fully wound roll and said first roll-winding roll from said winding bed;

(h) depositing another new roll-winding sleeve in said bed on said rollers; and (i) driving both of said rollers to advance said leading end of said web and adhesive thereon into contact with said other new roll-winding sleeve and effect winding of said web thereon to form a fully wound roll.

2. The method defined in claim 1 wherein, said method further comprising the steps of: lifting the fully wound roll from said first roller by an ejection roller bearing on said fully wound roll, thereafter passing said trailing end between said fully wound roll and said ejection roller, and pushing the ejection roller thereafter said fully wound roll over said second roller from said winding bed.

3. An apparatus for winding a web into a roll, comprising:

a first horizontal support roller and a horizontal second support roller spaced from said first support roller and defining a horizontal gap therewith, said support rollers forming a winding bed in which a roll is received for winding of a web on a sleeve, said support rollers being driven to frictionally entrain a roll in said winding bed and wind a wed thereon, said web being fed from below through said gap along said first support roller to said winding bed;

roll-ejection means for lifting a fully wound roll from said bed and thereby discharging said fully wound roll from said bed;

sleeve-insertion means for introducing a new roll winding sleeve into said bed;

web-weakening means along said web upstream of contact of said web with said first support roller for weakening said web along a separation line formed in the web, said weakening means including a perforating device for perforating said web along said separating line across said web;

brake means upstream of said weakening means for preventing the advancement of said web, control means, operatively connected to said brake means and said perforating device, for actuating said perforating device after said brake means is actuated to prevent advancement of said web;

adhesive-applicator means for applying adhesive a said web so that adhesive is present thereon on opposite sides of said separation line in a direction of travel of the web; and clamping means in said gap for selectively clamping said web against said first support roller, said clamping means including a support, means for raising and lowering said support in said gap, and a freely rotatable clamping roller on said support resiliently engageable with said web to clamp said web against said first support roller in a region of said bed.

4. The apparatus defined in claim 3 wherein said first support roller is a suction roller retaining said web thereagainst under suction, said support being provided with a swingable separating blade pivotable toward said first support roller and forming a tearing edge for separating said web along said separating line.

5. The apparatus defined in claim 4 wherein said adhesive-applicator means includes means for applying adhesive tape strips on opposite sides of said separating line.

6. The apparatus defined in claim 5 wherein said adhesive-applicator means is mounted on said perforating device.

7. The apparatus defined in claim 5 wherein said adhesive-applicator means is provided between said perforating device and said first support roller.

* * * * *